US005197098A

United States Patent [19]

Drapeau

[11] Patent Number: 5,197,098

[45] Date of Patent: Mar. 23, 1993

[54] SECURE CONFERENCING SYSTEM

[76] Inventor: Raoul E. Drapeau, 2410 Luckett Ave., Vienna, Va. 22180

[21] Appl. No.: 869,416

[22] Filed: Apr. 15, 1992

[51] Int. Cl.[5] ..... H04K 1/02

[52] U.S. Cl. ..... 380/6; 380/8; 380/52; 381/73.1; 381/158

[58] Field of Search ..... 380/6, 8, 9, 52, 53, 380/57; 381/158, 169, 73.1, 71

[56] References Cited

U.S. PATENT DOCUMENTS

| | | | |
|---|---|---|---|
| 1,368,261 | 2/1921 | Jenkins | 381/168 |
| 3,497,923 | 2/1970 | Todd | 380/6 |
| 3,541,258 | 11/1970 | Doyle et al. | 380/6 |
| 3,796,842 | 3/1974 | Guille | 381/158 |
| 3,879,578 | 4/1975 | Wildi | 381/73.1 |
| 3,980,827 | 9/1976 | Sepmeyer et al. | 381/73.1 |
| 3,992,584 | 11/1976 | Dugan | 381/73.1 |
| 4,010,324 | 3/1977 | Jarvis et al. | 381/73.1 |
| 4,429,187 | 1/1984 | Butcher | 381/80 |
| 4,524,452 | 6/1985 | Marashak | 381/21 |
| 4,834,212 | 5/1989 | Figone et al. | 381/158 X |

*Primary Examiner*—Tod Swann

[57] ABSTRACT

An audio system for conducting confidential multi-person conferences without the need for secure meeting facilities. Means for silently accepting spoken speech from a number of participants and making that speech available to all participants through headphones. Means for controlling the volume of the speech for each participant. Means for indicating which participant(s) are speaking. Means for masking any incidental speech escaping from masks. Means for alerting participants when speech is escaping from a mask. Means to allow modular expansion of the number of participants. Means for recording the meeting for later listening or transcription.

4 Claims, 2 Drawing Sheets

SECURE CONFERENCING SYSTEM

References Cited (U.S. Patents):
U.S. Pat. No. 3,879,578 Wildi: "Sound masking system"
U.S. Pat. No. 3,992,584 Dugan: "Automatic microphone mixer"
U.S. Pat. No. 4,010,324 Jarvis et al: "Background noise masking"
U.S. Pat. No. 4,429,187 Butcher: "Audio distributing system"
U.S. Pat. No. 4,524,452 Marshak: "Audio mixer/preamplifier"

The present invention relates generally to a multi-input audio mixing and distribution system with multiple-listeners, and more particularly to a multi-participant audio conferncing system that prevents unauthorized listeners from overhearing the conversation. Previous art describes systems for combining multiple audio input signals into one output (e.g. Dugan or Marshak), or distributing one signal to multiple listeners (e.g. Butcher), with no attempt to thwart eavesdroppers. The present invention describes a system for combining audio signals silently received from several persons and silently distributing that combined signal back to the same people, for the purpose of conducting a confidential meeting. The system also alerts the participants to a failure in the silencing means and masks any escaping sound.

BACKGROUND OF THE INVENTION

Previously, those organizations wishing to conduct a confidential meeting, secure from being overheard by unauthorized persons, were faced with a difficult and expensive problem. One solution was to locate a facility that had been specifically designed for the purpose. For complete security, however, the facility would have to be checked just prior to each meeting to make sure that all the various means to detect attempts at bugging and otherwise thwart eavesdroppers were operational, had been applied, and had not themselves been compromised.

Alternatively, the meeting could be held in an unsecure room in which provisions had been made for the presence of loud masking audible signals, such as running water or pseudo-random noise, to thwart eavesdroppers.

The cost and inconvenience of these methods made it expensive to conduct secure meetings, and only groups having access to such facilities could conduct such meetings. However, there are many government and private organizations that have the need for such confidentality, and the current invention addresses those needs.

Accordingly, it is the object of the present invention to provide a system that groups can use to conduct secure meetings at any convenient location, such as an ordinary business office or hotel room. The system is highly effective in defeating unauthorized listeners, and yet is small and portable enough to be quickly and easily set up. Power can be provided by a universal power supply that automatically adapts to power standards anywhere in the world. Hand-held speech masks (similar to those used by court stenographers) are used by participants when speaking. These masks cover a speaker's nose and mouth and effectively muffle a speaker's voice to those in the room not electrically connected to the system, such as those attempting to overhear the conversation.

Speech masks have small, integral microphones to carry the signal of each speaker's voice to a summing point in the system, and hence to all the participants. Thus, any number of participants, some or all of whom may be speaking at the moment, can be clearly heard by all other participants through their own headphones. Further, each participant has his own volume control and visual indicator. These visual indicators are driven by the signal from each participant's microphone, thus showing which participant(s) are speaking at an moment. Because direct sound from speakers' mouths is muffled, this feature allows participants to discern who is speaking in case the voice is unfamiliar.

An audio output means is provided so that the proceedings can be recorded by a miniature speech recorder for later transcription.

All of these capabilities are provided in master control unit. In addition, provision is made for the connection of additional slave control units, so that a greater number of participants can be accommodated.

Even though any speech that escapes from a speaker's mask is muffled and difficult to understand, means are provided to mask any such spurious sound, or alternatively to alert the paticipants that speech is escaping from one of the masks so that they will take corrective action. The masking means can be implemented either by the emission of a continuous pseudo-random masking signal on an associated loudspeaker, or by using pressure sensors on the mask to detect imperfect contact with the user's face, thereby sensing the fact that sound may be escaping from a participant's mask and then emit or strengthen the masking sound accordingly. The alerting means can be implemented by using a visual or audible annunciator triggered by the system when it senses that speech may be escaping.

The objects and advantages of the present invention will be clearly understood from the following description, taken in conjunction with the drawings.

DETAILED DESCRIPTION OF A PREFERRED EMBODIMENT OF THE INVENTION

Figures 1, 2:
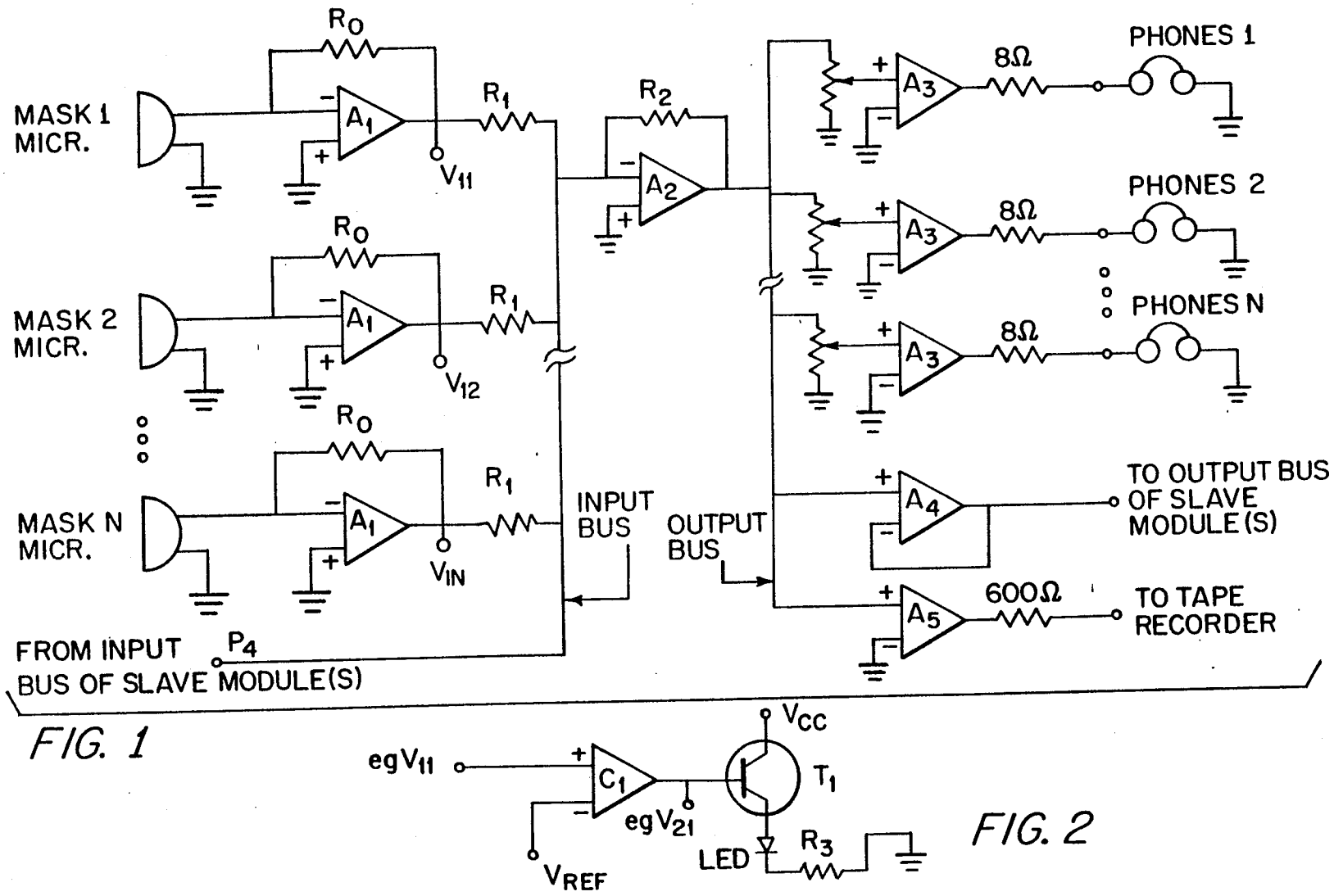
FIG. 1 is a detailed schematic block diagram of a multiple-participant master control unit used in the present invention.
FIG. 2 is a detailed schematic diagram of one indicator control circuit.

The schematic of FIG. 1 shows a master control unit accomodating a number of participants, N. (For simplicity in this and following schematic drawings, some circuit elements such as bias voltages and coupling and bypassing capacitors are omitted.) The microphone for each participant has an amplifier $A_1$, such as National Instruments LM324. The gain of this stage is determined by selecting the $R_1/R_0$ ratio to suit the characteristics of the microphones. The output of each of these amplifiers is led to the input bus through their output resistor $R_1$, where it is summed (i.e. mixed) with all the contribution from all the other microphone amplifiers. The summing amplifier, $A_2$, also an LM324, has a feedback resistor $R_2$ that determines the output voltage of that stage, according to the expression relating the a-c components:

$$V_2=(R_2/R_1)\times(V_{11}+V_{12}+\ldots+V_{1N}).$$

The output of the summing amplifier $A_2$ drives the output bus, and hence the input to each participant's headphone amplifier, $A_3$. This amplifier may be implemented using a low-power audio amplifier such as the National Instruments LM380N-8. Each of these amplifiers has some means such as a volume control for controlling its output level to the headphones.

In addition to the individual participant's output amplifiers, other devices may be connected to the master control unit as follows:

$P_4$ is the point at which the input bus of slave control unit(s) are introduced into the master control unit to be summed.

$A_4$ is an isolating unity-gain amplifier that provides a driving summed signal to the output bus of slave control units (slave control units derive their output signal from the master control unit, and do not have a summing amplifier, $A_2$. In other respects, they are identical to the master control unit).

$A_5$ is an isolating amplifier that provides the appropriate level signal (e.g. 0.7 volt, 600 ohm) to an associated tape recorder.

The schematic of FIG. 2 shows the circuit of one of the indicator drivers. Each of the microphone amplifiers, $A_1$, would have one of these circuits connected to its output. The amplified signal from a microphone, such as $V_{11}$, is introduced into one input of an analog comparator, $A_6$, such as National Instruments LM339. The other input is a reference voltage, slightly less than the ground reference of the ac signal, such that if the participant is speaking and his microphone is producing a viable signal, then the comparator will go into its TRUE state during the positive portion of the audio signal. This condition causes the attached NPN transistor $T_1$, such as a Motorola MPS 2222, to forward bias for that time, thereby activitating the indicating LED through the current-limiting resistor, $R_3$. Otherwise, the LED is held off.

Figure 3:
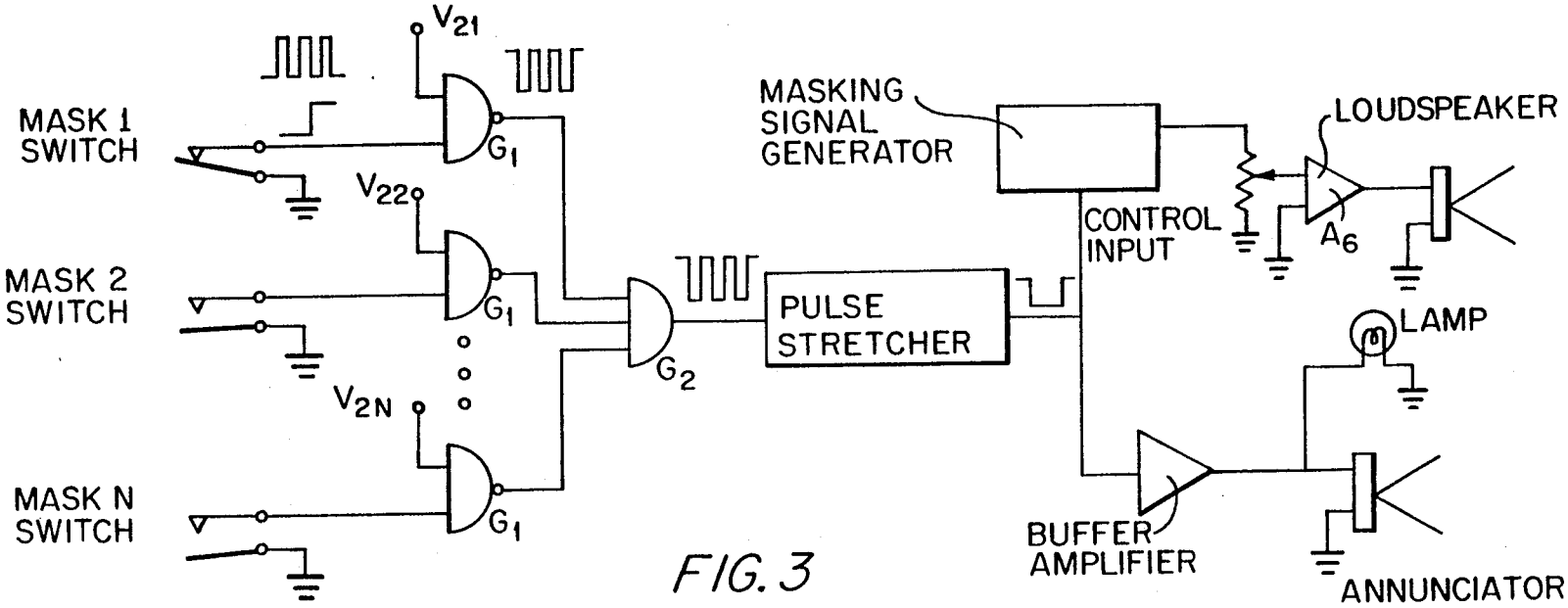
FIG. 3 is a detailed schematic diagram of the speech-escape sensing, masking and annunciation circuits.

FIG. 3 is a schematic drawing of a sound-escape sensing, speech-masking and user-alerting circuit. Each microphone has switch(es), $S_1$, that detect whether participants are maintaining intimate contact with their face or not. This sensing function may be implemented in several ways, one of which is to use several discrete, normally-open, pressure-sensitive switches connected in series and mounted at key points around the periphery of the mask. The switch(ed) are mounted under the soft, flexible material of the mask itself that normally assures good contact between the mask and the user's face.

When a participant is properly using a speech mask, the pressure-sensing switch(es) remain closed. However, if the participant is speaking, but not holding the mask tightly against the face, then sound may escape and be overheard. In this case, however, one or more of the pressure-sensitive switches will open, thereby placing a high-going signal at one input of the NAND gate $G_1$. The other input to this gate is provided by the output of that participant's comparator, such as $V_{21}$. Thus, if that participant is still speaking when the mask is no longer in intimate contact with the face, then both inputs are high and the output of gate $G_1$ is forced low. All $G_1$ outputs are led to the OR gate, $G_2$. Thus, if any of the participants does not use the proper pressure on their mask and is speaking at the time, then $G_2$ will produce a periodic low-going signal at its output at an audio rate.

The output of $G_2$ is led to a pulse-stretching circuit, typically implemented as a National Instrument LM555. It produces a continuous pulse, typically a fraction of a second long, and is re-triggered whenever any participant is speaking and that mask's switch is open. This stretched pulse, which corresponds to the envelope of the speech from a speaker(s) not maintaining proper mask-face contact, is led to the control input of the masking signal generator.

This same pulse-stretched signal can be used with suitable buffering, to control an annunciator; typically a piezoelectric buzzer or a bright lamp. In this case, the purpose is not to mask the escaping speech, but rather to unequivocally alert the participants that one of them is not using the apparatus properly.

The audio masking signal generator provides the input to the loudspeaker amplifier, $A_6$. $A_6$ can be any common, moderate-power audio amplifier IC, such as the National Instruments LM380. The masking signal generator can be a simple circuit, amplifying and suitably shaping in frequency response, pseudo-random noise signal, such as that described by Jarvis et al. Alternatively, it can be a more complex circuit that operates on the audio itself, such as that described by Wildi.

Whatever the derivation of the masking signal, it may be emitted at all times, or modulated by controlling its amplitude under certain conditions, such as the improper mask-to-face seal on the part of one or more of the participants.

Figure 4B:
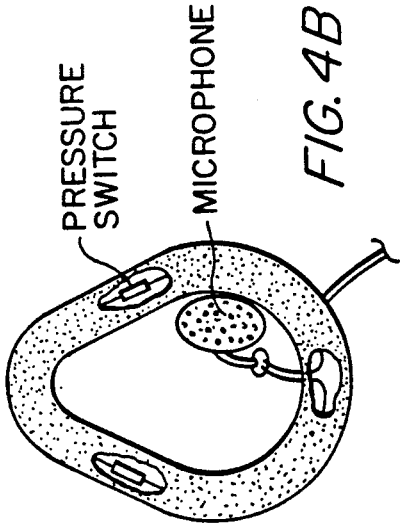
FIG. 4 is a sketch of a typical speech mask with microphone and pressure sensors.
Figure 4A:
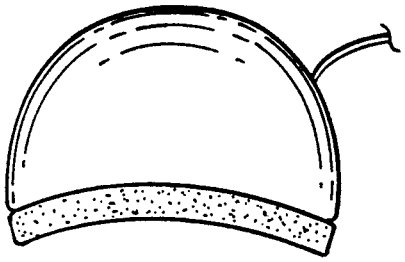

FIG. 4 is a sketch showing a front view of a typical hand-held stenographer's mask, such as that made by Martel Electronics or Talk, Incorporated. The mask contains a microphone and around its periphery are shown several discrete pressure-sensitive switches connected in series. These switches would be typically mounted under the molding that surrounds the unit where it meets the user's face. When proper pressure of the mask against the face is maintained, all the switches would be in their closed state.

I claim:

1. An audio conferencing system for insuring that multi-person meetings remain confidential comprising mask means for silently accepting spoken speech from a number of participants and converting that speech into an electrical signal;

linear mixing means for combining such signals from all participants;

amplifier means for making the mixed speech available to all participants through headphones;

means for controlling the volume of the speech delivered to each participant's headphones;

indicator means for indicating which participant(s) are speaking;

output means to allow modular expansion of the number of participants;

output means to allow recording the mixed signal for later transcription.

2. The audio conferencing system of claim 1 further comprising the addition of a circuit to emit a continuous audio masking signal.

3. The audio conferencing system of claim 1 further comprising the addition of a circuit to emit an audio masking signal keyed by the opening of a pressure sensing switch on a speech mask in the presence of speech from that participant.

4. The audio conferencing system of claim 1 further comprising the addition of a circuit to emit an audio or visual warning signal keyed by the opening of a pressure sensing switch on a speech mask in the presence of speech from that participant.

* * * * *